United States Patent [19]

Adams

[11] 4,226,199

[45] Oct. 7, 1980

[54] SEWING MACHINE SIX MOTION WORK FEEDING MECHANISM

[75] Inventor: Kenneth D. Adams, Madison, N.J.

[73] Assignee: The Singer Company, Stamford, Conn.

[21] Appl. No.: 100,762

[22] Filed: Dec. 6, 1979

[51] Int. Cl.[3] ..... D05B 27/00

[52] U.S. Cl. ..... 112/308; 112/158 E

[58] Field of Search ..... 112/308, 309, 303, 158 E, 112/157, 121.11, 121.12, 323

[56] References Cited

U.S. PATENT DOCUMENTS

| | | | |
|---|---|---|---|
| 2,311,222 | 2/1943 | Galkin | 112/308 |
| 3,026,832 | 3/1962 | Taketomi | 112/308 |
| 3,096,737 | 7/1963 | Bono | 112/308 |
| 3,527,183 | 9/1970 | Szostak | 112/323 |
| 3,561,382 | 2/1971 | Ketterer et al. | 112/308 X |
| 3,855,956 | 12/1974 | Wurst | 112/158 E |
| 3,921,552 | 11/1975 | Daman et al. | 112/323 |
| 4,187,794 | 2/1980 | Ross et al. | 112/308 |

*Primary Examiner*—H. Hampton Hunter

*Attorney, Agent, or Firm*—James M. Trygg; Edward L. Bell; Robert E. Smith

[57] ABSTRACT

A work feeding mechanism for sewing machines including a feed dog with two pair of mutually orthogonal serrated teeth to drive a fabric past a stitch forming area in directions defined by mutually orthogonal axes. The feed dog is slidably mounted to a bracket which in turn is pivotally fastened to one extremity of a feed bar whose opposite extremity is suspended by gimbals carried in the bed. Means are disclosed to selectively impart oscillations of a varying amplitude and direction to the slidable feed dog in timed synchronization to the work feeding mechanism to drive the feed dog in lateral and longitudinal directions of fabric feeding motion which extend along the length of the sewing machine bed and normal to the length of the bed. Fabric feeding information for the work feeding mechanism may be stored in an electronic memory to permit the production of ornamental stitch patterns.

6 Claims, 5 Drawing Figures

SEWING MACHINE SIX MOTION WORK FEEDING MECHANISM

BACKGROUND OF THE INVENTION

This invention relates to sewing machines in general, and more particularly to a work feeding mechanism which permits a fabric or garment to be fed past the stitch forming area in directions defined by two mutually orthogonal axes.

Sewing machines having mechanical elements for effecting fabric feeding to the right or left sides of a normal line of feeding are known in the prior art. Such machines frequently employ cams which impart fabric feeding motion to the feed dog through mechanical arrangements which are difficult to manipulate to achieve a variety of intricate stitch patterns. Sewing machines are also known in the prior art which employ linear actuators to permit the production of intricate ornamental stitches from patterns which are stored in electronic memories. See for example U.S. Pat. No. 3,855,956, Dec. 24, 1974, Wurst which is owned by the assignee of this invention and the teachings of which are incorporated herein by reference. While such machines have the capability of producing a wide variety of ornamental stitches, they are not able to produce stitches in which the pattern width, or bight exceeds the maximum relative displacement between the sewing needle and the looptaker at which a stitch may be formed. Additionally, see application Ser. No. 40,021 dated May 18, 1979 which is also owned by the assignee of this invention and the teachings of which are incorporated herein by reference.

Sewing machines are also known in which a periodic swinging of the needle bar, while the needle is penetrating the material being sewn, produces lateral fabric feeding motion to the right or left of the normal line of fabric feeding. See, for instance, U.S. Pat. No. 3,561,382, Feb. 9, 1971, Ketterer. With such work feeding mechanisms however, the ability of the sewing machine to produce zig zag stitch patterns while feeding to the right or left is curtailed.

The above citations comprise what the applicant believes to be the closest art of which he is aware that is relevant to the examination of this application.

SUMMARY OF THE INVENTION

It is an object of this invention to produce a sewing machine work feeding mechanism of the type which intermittently engages the work fabric which is compatible with electronically controlled sewing machines having stitch forming instrumentalities which are responsive to stitch pattern information stored in electronic memories.

Another object of this invention is to produce a work feeding mechanism which will not interfere with straight line stitching.

Another object of this invention is to produce a work feeding mechanism in which lateral fabric feeding to the right or left of a normal line of fabric feeding is produced by motion of the feed dog.

Still another object of this invention is to produce a work feeding mechanism whereby inertia of selected moving parts is minimized and their manufacture simplified.

Other objects and advantages of the invention will become apparent through reference to the accompanying drawings and descriptive matter which illustrates a preferred embodiment of the invention.

According to the present invention, there is provided a work feeding mechanism for a sewing machine having a work supporting bed with an axis along its length and a throat plate having a set of mutually orthogonal feed dog accommodating slots defining mutually perpendicular directions of work feeding along the surface of the bed. The directions comprise a longitudinal direction of feeding extending in a direction transverse to the axis along the length of the bed and a lateral direction of fabric feeding perpendicular to the longitudinal direction. There is an elongated feed bar carried beneath the bed and extending substantially along the length of the work supporting bed. A feed dog bracket is pivotally supported at one extremity of the feed bar for supporting a feed dog having a set of mutually orthogonal work engaging teeth positioned to be accommodated within the feed dog accommodating slots. Slidable means is provided for supporting the feed dog on the bracket such that the feed dog is constrained to slide along a line extending parallel to the axis of the bed.

Gimbal means fastened to and supporting the extremity of the feed bar opposite the extremity having the feed dog pivotally fastened thereto, permits said feed dog to be driven in the longitudinal direction transversely across the bed and in a direction above and below the throat plate.

A feed bar drive mechanism is provided which is operable in timed relation to the sewing machine for imparting oscillations to the feed bar about the gimbal means in mutually perpendicular directions, including the longitudinal direction transversely across the bed to provide work advancing and return movements to the feed dog, and in the direction above and below the throat plate to raise the feed dog to a position above the throat plate during work advancing movement and to drop the feed dog below the throat plate during the return movement thereof.

Means driven by the feed bar drive mechanism is included for imparting oscillatory motion to the slidable means along the line extending parallel to the axis of the bed.

An adjustable control means is responsive to electrical signals for varying the amplitude and direction of oscillatory motion imparted to the slidable means by the oscillatory drive means.

BRIEF DESCRIPTION OF THE DRAWINGS

In order that the invention be more fully understood it will now be described by way of example, with reference to the accompanying drawings in which.

DESCRIPTION OF THE PREFERRED EMBODIMENT

Figures 1, 2:
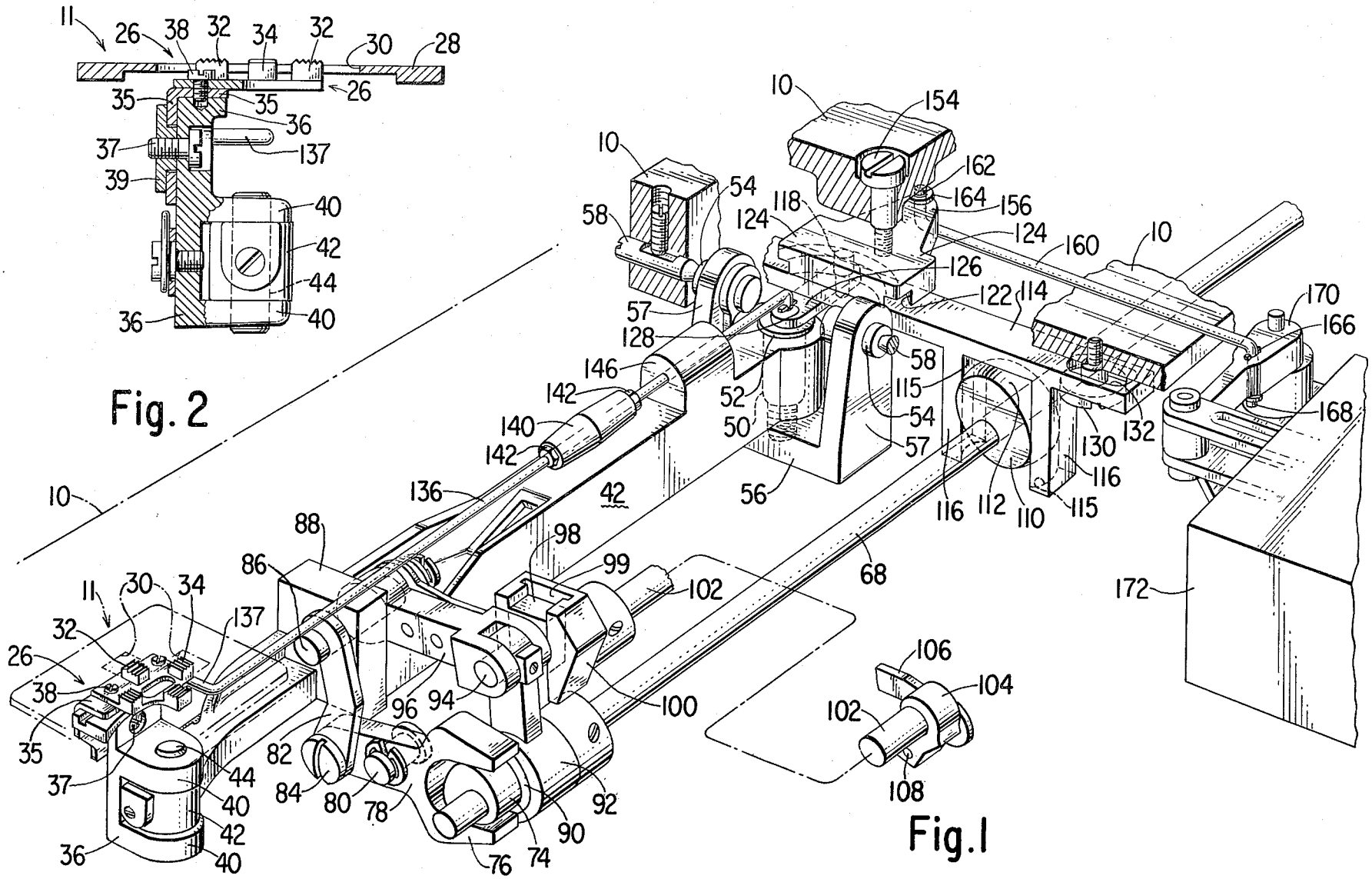
FIG. 1 is a perspective view of a work feeding mechanism illustrating a preferred embodiment of the invention.
FIG. 2 is a cross section of the feed dog holder shown in FIG. 1.

Referring to FIGS. 1, 2, 3, 4 and 5, a sewing machine is shown having a work supporting bed 10 with an axis extending along its length. A standard (not shown) rises from the bed 10 and supports an arm (not shown) which overhangs the bed 10 and terminates in a sewing head (not shown) for housing stitch forming instrumentalities. There is a stitch forming area 11 contained on the surface of the bed 10. A feed dog which is shown generally at 26 moves the fabric toward and away from the needle penetrating stitch forming area 11. A throat plate 28 which contains a set of mutually orthogonal feed dog accommodating slots 30 is removably carried flush to the surface of the bed 10 and acts to support the fabric against the downward thrust of the needle. The feed dog 26 has a first pair of serrated teeth 32 positioned to move fabric in a normal longitudinal line of fabric feeding which is directed in a line which runs substantially perpendicular to the length of the sewing machine bed 10 and a second pair of serrated teeth 34 positioned to move fabric laterally along the length of the bed 10. FIG. 2 illustrates that the feed dog 26 is preferably fastened to a slide bracket 35 by a set of fasteners such as screws 38 wherein the slide bracket is slidably attached to the feed dog bracket 36 by the lock screw 37 and retained nut 39. The feed dog bracket 36 has a pair of ears 40 which accommodate one extremity of an elongated feed bar which is shown generally at 42. Preferably, the feed dog bracket 36 is pivotally fastened to the feed bar 42 with a cylindrical pivot pin 44 which allows the bracket 36 to pivot with respect to the feed bar 42.

It will be appreciated by those skilled in the art of sewing machine design that it is necessary to move a fabric being sewn past the stitch forming area on the sewing machine bed so that the reciprocating needle may penetrate it to produce stitches at periodic intervals along the fabric. One preferred example of the work feeding mechanism which may be employed to produce fabric feeding movement in a normal line of feed, i.e., a straight line transversely across the sewing machine bed is more fully discloses in U.S. Pat. No. 3,527,183, Sept. 8, 1970, Szostak, the rights to which are owned by the assignee of this invention and the teachings of which are incorporated herein by reference. As more difficult sewing projects are undertaken however, a skilled sewer will become increasingly aware of the advantages of being able to move the fabric being sewn laterally to both the left and right sides of the normal line of fabric feeding which is defined as a line extending transversely across the bed 10, in a direction which is perpendicular to the length of the bed 10.

The extremity of the elongated feed bar 42 opposite the feed dog 26 is suspended by a pivot pin 50, having an enlarged head 52, which passes through the base of a yoke 56 having two ears 57 formed at right angles thereto. The pivot pin 50 having a vertical axis, permits the feed bar 42 to oscillate relative to the yoke 56 in a plane that is parallel to the work supporting surface of the bed 10. The yoke 56 is suspended by a set of pintles 58 which engage a pair of conical seats not shown in a pair of trunion pins 54 which protrude from the ears 57 of the yoke 56. The set of pintles 58 are held fast to the frame by a pair of saddles not shown. It is to be understood that the combination of the pivot pin 50 and the pintles 58 form gimbals which permit the feed bar 42 to be oscillated in mutually perpendicular directions, one direction moving the feed dog 26 toward and away from the throat plate 28 to move the teeth of the feed dog 26 above and below the throat plate 28, and a second direction moving the feed dog 26 transversely across the surface of the bed 10, thereby defining the normal or longitudinal line of fabric feeding such as that described in the aforementioned patent to Szostak.

A feed drive shaft 68, a portion of which is shown in FIG. 1, has fastened thereto a constant breadth feed lift cam 74 which is embraced by a bifurcated extremity 76 of a lever 78 which is fulcrummed on a stud 80 fastened to the bed 10. A link 82 is pivotally fastened to the lever 78 at one extremity thereof by a shouldered fastener 84. The other extremity of the link 82 is pivotally fastened by a pin 86 to a block 88 which is rigidly attached to the feed bar 42.

A feed advance eccentric 90 is also fastened to the shaft 68 and is embraced by a pitman 92 which is connected by a pivot pin 94 to a link 96 whose opposite extremity pivotally engages the pin 86 carried by the block 88.

The link 96 and the pitman 92 together define a toggle at the pivotal connection therebetween provided by the pivot pin 94. The motion of the toggle in response to rotation of the feed advance eccentric 90 is controlled by a slide block 98 to which the pivot pin 94 is fastened. The block 98 is constrained to a guide slot 99 formed in a block 100 which is made fast to the feed control rock shaft 102. A crank 104 is fastened to the rock shaft 102 and has a pivotal link 106 attached thereto with a pivot pin 108. Preferably the link 106 is fastened to a linear actuator (not shown) having a position sensor preferably a potentiometer. The linear actuator may be excited electrically to vary the angular displacement of the block 100. As is more completely described in the aforementioned patent of Szostak, the motion imparted to the feed dog 26 by the feed bar 42 in response to the constant breadth cam 74 and the feed advance eccentric 90 occurs in arcuate paths about the mutually perpendicular axis of the gimbals defined by the pivot pin 50 and the pintles 58, the angular displacement of the block 100 defining the length of longitudinal feed advance in a direction transverse to the length of the sewing machine bed 10 imparted to the fabric by the feed dog 26.

Oscillatory fabric feeding motion in lateral directions to the right or left of the normal line of material feed is imparted to the slide bracket 35 by an eccentric cam 110 which is fixed to the feed drive shaft 68 and rotates therewith. The eccentric cam 110 having a spherical tracking surface 112 operationally engages the bifurcated extremities 116 of a drive link 114 having cylindrically concave cam engaging surfaces 115 adapted to engage the spherical cam surface 112. The drive link 114 is constrained to move in a plane which is parallel to the work supporting surface of the bed 10 by a set of fasteners such as two large head shoulder screws 130 (one not shown) which threadingly engage the bed 10 such that the drive link 114 is held slidingly captive between the heads of the screws 130 and the bed 10. Two elongated holes 132 (one not shown) are formed in the extremities of the drive link 114 and embrace the shoulder portions of the screws 130. The elongated holes are dimensioned to permit full sliding movement of the drive link 114 imparted thereto by both the eccentric cam 110 and the arcuate track 122, the relationship of which is explained below. The drive link 114 has a perforation near its extremity furthest from the bifurcated extremities 116 for pivotal engagement with the slide pin 118. The slide pin 118, one end of which is ridgedly attached to one extremity of the toggle link 126, projects through the perforation in the link 114 and slidingly engages the arcuate track 122 and is held captive therein by means well known to those skilled in the art. The other extremity of the toggle link 126 has a conically shaped perforation 128 for pivotally receiving an end 135 of a first push rod 134. The end 135 being formed at right angles to the push rod 134 has a snap ring 138 attached thereto for retaining the push rod 134 in operational engagement with the toggle link 126. The other end of the first push rod 134 threadingly engages a lock nut 142 and one end of a turnbuckle 140. Intermediate the nut 142 and the end 135, the push rod 134 slidingly engages, and is supported by, a perforation 144 that is formed in the boss 146 of the elongated feed bar 42 wherein the axis of the perforation 144 is substantially perpendicular and sufficiently vertically above the horizontal pivot center line 150 formed by the pintles 58 that the upper surface 148 of the toggle link 126 may be substantially aligned with the center line 150, and the end 135 may traverse directly over the vertical axis of the pivot pin 50. The second push rod 136 threadingly engages a lock nut 142 and the other end of the turnbuckle 140 and has an end 137 formed at right angles thereto for engagement with a perforation 152 in the slide bracket 35 for imparting a back and forth sliding motion thereto. The dimples 166 formed in the end 137 cooperate with a snap ring 138 attached thereto for retaining the push rod 136 in operational engagement with the slide bracket 35.

The arcuate track 122 is formed in the control bracket 124 which is pivotally supported by the bed 10 and the shoulder screw 154. An ear 156 formed in the control bracket 124 has a perforation 158 which is positioned such that the shoulder screw 154 is interposed between the arcuate track 122 and the perforation 158. A control rod 160 has a first end 162 formed at right angles thereto for pivotal engagement with the perforation 158 and a snap ring 164 attached thereto for retaining the control bracket 124 and the control rod 160 in operational engagement. The control rod 160 has a second end 168 formed at right angles thereto and in a direction opposite that of the first end 162 for pivotal engagement with a control arm 170 of a linear actuator 172 for imparting pivotal motion to the control bracket 122 through the control rod 160. The dimples 166 formed in the second end 168 aid in maintaining operational alignment between the control rod 160 and the control arm 170.

Figure 3:
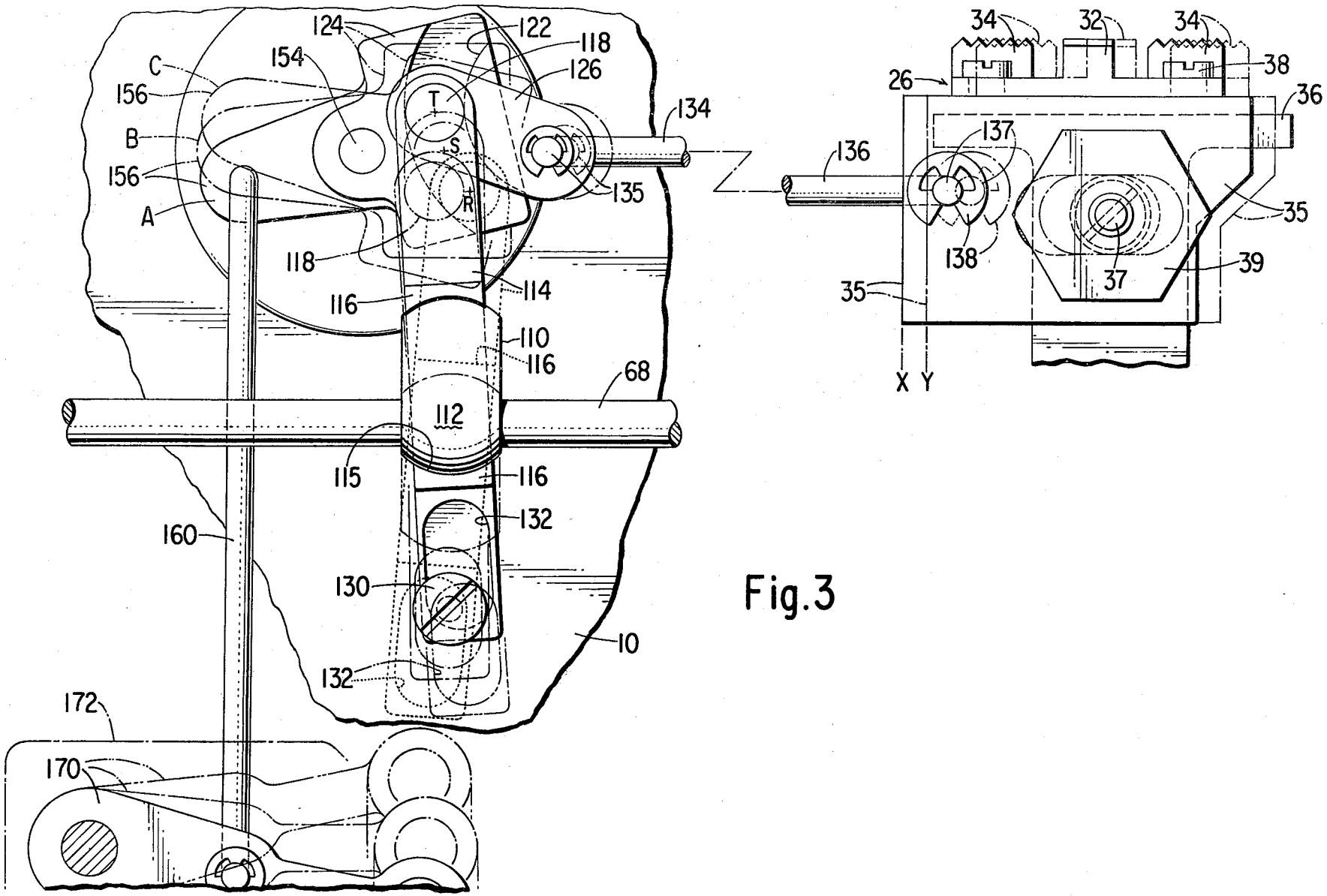
FIG. 3 is a bottom partial view of the oscillatory drive means showing the feed dog and slide bracket rotated 90°.
Figures 4, 5:
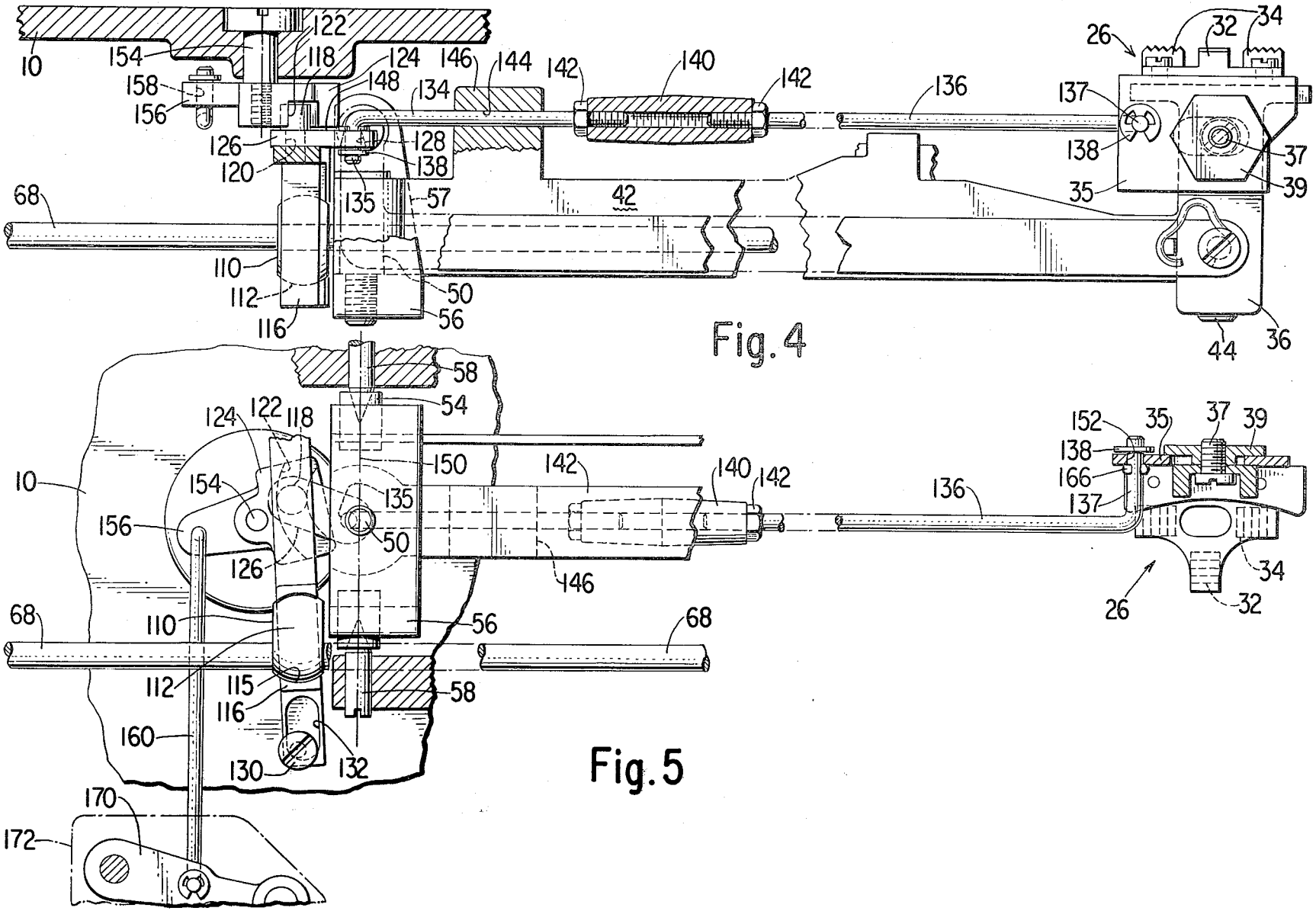
FIG. 4 is a rear elevation view of the work feeding mechanism.
FIG. 5 is a bottom view of the work feeding mechanism.

In operation, see FIG. 3, with the control bracket 124 positioned as shown at B, its neutral position, the center of curvature of the arcuate track 122 substantially coincides with the center of the conical perforation 128 pivotally containing the end 135 of the push rod 134. As the feed drive shaft 68 rotates the eccentric cam 110, the drive link 114 is made to reciprocate such that the slide pin 118 will oscillate within the arcuate track 122 causing the toggle link 126 to pivot about the center of the conical perforation 128.

When lateral fabric feeding to the left is desired, the linear actuator 172 is energized such that the control rod 160 positions the control bracket 124 as shown at A. This moves the center of curvature of the arcuate track 122 out of coincidence with the center of the conical perforation 128 so that as the slide pin 118 oscillates within the arcuate track 122, the toggle link 126 will impart an oscillatory motion to the push rod 134 and thereby impart a lateral oscillatory motion to the slide bracket 35. As the slide pin 118 moves from position R to position T, the slide bracket 35 is urged to move from position Y to position X. When lateral fabric feeding to the right is desired, the linear actuator 172 is energized such that the control rod 160 positions the control bracket 124 as shown at C, resulting in an action similar to that described above but with opposite effect.

It will be understood that the linear actuator 172 may vary the position of the control bracket 124 from A to C or any intermediate position, either independent of or in cooperation with the standard longitudinal feed, both forward and reverse, of the sewing machine.

I claim:

1. A work feeding mechanism for a sewing machine having a work supporting bed with an axis along its length, a throat plate having a set of mutually orthogonal feed dog accommodating slots defining mutually perpendicular directions of work feeding along the surface of said bed, said directions comprising a longitudinal direction of feeding extending in a direction transverse to the axis along the length of said bed, and a lateral direction of fabric feeding perpendicular to said longitudinal direction, an elongated feed bar carried beneath said bed and extending substantially along the length of said work supporting bed, a feed dog bracket pivotally supported at one extremity of said feed bar including a feed dog having a set of mutually orthogonal work engaging teeth positioned to be accommodated within said feed dog accommodating slots and slidable means for supporting said feed dog on said bracket wherein said feed dog is constrained to slide along a line extending parallel to said axis of said bed, gimbal means having a vertical axis pivot, said gimbal means fastened to said feed bar and supporting the extremity of said feed bar opposite the extremity having said feed dog pivotally fastened thereto to permit said feed dog to be driven in said longitudinal direction transversely across said bed and in a direction above and below said throat plate, a feed bar drive mechanism operable in timed relation to said sewing machine for imparting oscillations to said feed bar about said gimbal means in mutually perpendicular directions, including said longitudinal direction transversely across said bed to provide work advancing and return movements to said feed dog, and in said direction above and below said throat plate to raise said feed dog to a position above said throat plate during work advancing movement and to drop said feed dog below said throat plate during the return movement thereof, means driven by said feed bar drive mechanism for imparting oscillatory motion to said feed dog along said line constrained by said slidable means and extending parallel to said axis of said bed, and adjustable control means responsive to electrical signals for varying the amplitude and direction of oscillatory motion imparted to said slidable means by said oscillatory drive means.

2. The work feeding mechanism as set forth in claim 1 wherein said means for imparting oscillatory motion to said feed dog comprises:

a. an eccentric cam rotatably driven by said drive mechanism in timed relation to said oscillations imparted to said feed bar;

b. a drive link having said oscillatory motion imparted thereto by rotation of said eccentric cam;

c. toggle means being pivotally attached to an extremity of said drive link at a common point for transmitting said oscillatory motion to said feed dog.

3. The work feeding mechanism as set forth in claim 2 wherein said adjustable control means comprises:

a. an arcuate track pivotally supported in said frame such that said arcuate track may be adjustably pivoted in a plane parallel to said oscillatory motions of said drive link;

b. a slide member being pivotally attached to said drive link and said toggle means at said common point, said slide member adapted for sliding engagement with said arcuate track;

c. an electronically driven position varying means adapted to effect said adjustable pivoting of said arcuate track for controlling the amplitude and direction of said oscillatory motion imparted to said feed dog.

4. The work feeding mechanism as set forth in claim 3 wherein said electronically driven position varying means comprises a linear actuator.

5. The work feeding mechanism as set forth in claims 3 or 4 wherein said toggle means comprises a toggle link one extremity of which is pivotally attached to said drive link and said slide member at said common point and the other extremity of which is attached to one extremity of a push rod by means of a pivot having an axis substantially coincident with said vertical axis pivot of said gimbal means, the other extremity of said push rod being attached to said slidable means, said push rod being constrained to move along said line extending parallel to said axis of said bed for imparting said oscillatory motion to said feed dog.

6. The work feeding mechanism as set forth in claim 1 further comprising electronic memory means for storing needle position information and information for moving said feed dog in said lateral and said longitudinal directions, and means for operating said electronically driven position varying means in response to information stored in said electronic memory means.

* * * * *